US010690436B1

(12) United States Patent
Kempf et al.

(10) Patent No.: US 10,690,436 B1
(45) Date of Patent: Jun. 23, 2020

(54) CROSSBOW WITH INTEGRAL COCKING AND A MOVING LATCH ASSEMBLY

(71) Applicants: James J. Kempf, Coralville, IA (US); Rex E. Isenhower, Stanwood, IA (US)

(72) Inventors: James J. Kempf, Coralville, IA (US); Rex E. Isenhower, Stanwood, IA (US)

(73) Assignee: ARCHERY INNOVATORS, LLC, Tiffin, IA (US)

( * ) Notice: Subject to any disclaimer, the term of this patent is extended or adjusted under 35 U.S.C. 154(b) by 0 days.

(21) Appl. No.: 16/360,122

(22) Filed: Mar. 21, 2019

Related U.S. Application Data

(60) Provisional application No. 62/653,573, filed on Apr. 6, 2018.

(51) Int. Cl.
*F41B 5/12* (2006.01)
*F41B 5/14* (2006.01)

(52) U.S. Cl.
CPC ..... *F41B 5/123* (2013.01); *F41B 5/12* (2013.01); *F41B 5/1469* (2013.01)

(58) Field of Classification Search
CPC ..... F41B 5/12
See application file for complete search history.

(56) References Cited

U.S. PATENT DOCUMENTS

| | | | | |
|---|---|---|---|---|
| 8,453,631 | B1 * | 6/2013 | Kronengold | F41A 11/02 124/25 |
| 9,341,432 | B1 * | 5/2016 | Wohleb | F16H 25/20 |
| 9,404,706 | B2 * | 8/2016 | Khoshnood | F41B 5/1469 |
| 9,719,749 | B1 * | 8/2017 | Prior | F41B 5/0094 |
| 9,958,232 | B1 * | 5/2018 | Egerdee | F41B 5/1403 |
| 10,139,188 | B2 * | 11/2018 | Shaffer | F41B 5/12 |

* cited by examiner

*Primary Examiner* — John A Ricci
(74) *Attorney, Agent, or Firm* — Donald J. Ersler

(57) ABSTRACT

A crossbow having a built in manual cocking mechanism that may also be utilized with an optional built in, removable motor gearbox assembly and power source. The motor gearbox assembly may or may not have a clutch assembly, whereby rotational force reaches a predetermined amount, rotation of the drive shaft ceases. Switches may be provided to start, stop, and reverse the direction of rotation of the motor gearbox assembly, as well as switches and or circuits that may control operation of the motor gear set.

14 Claims, 17 Drawing Sheets

CROSSBOW WITH INTEGRAL COCKING AND A MOVING LATCH ASSEMBLY

CROSS-REFERENCES TO RELATED APPLICATIONS

This is a non-provisional patent application, which claims the benefit of provisional application No. 62/653,573, filed on Apr. 6, 2018.

BACKGROUND OF THE INVENTION

1. Field of the Invention

The present invention relates generally to archery and more specifically to a crossbow with integral cocking and a moving latch assembly, which includes a removal electric motor.

2. Discussion of the Prior Art

It appears that the prior art does not teach or suggest a crossbow with integral cocking and a moving latch assembly.

SUMMARY OF THE INVENTION

The enclosed invention discloses a crossbow, and more specifically a built in cocking mechanism for a crossbow that may also be utilized with an optional built in, removable motor gearbox assembly and power source. The motor gearbox assembly may or may not have a clutch assembly, whereby the rotational force applied by the said motor gearbox assembly reaches a predetermined amount of force, the rotation of the main drive shaft ceases. A switch may be provided as to start, stop, and reverse the direction of rotation of the motor gearbox assembly, as well as switches and or circuits that may control operation of the motor gear set.

DETAILED DESCRIPTION OF THE INVENTION

Figure 1:
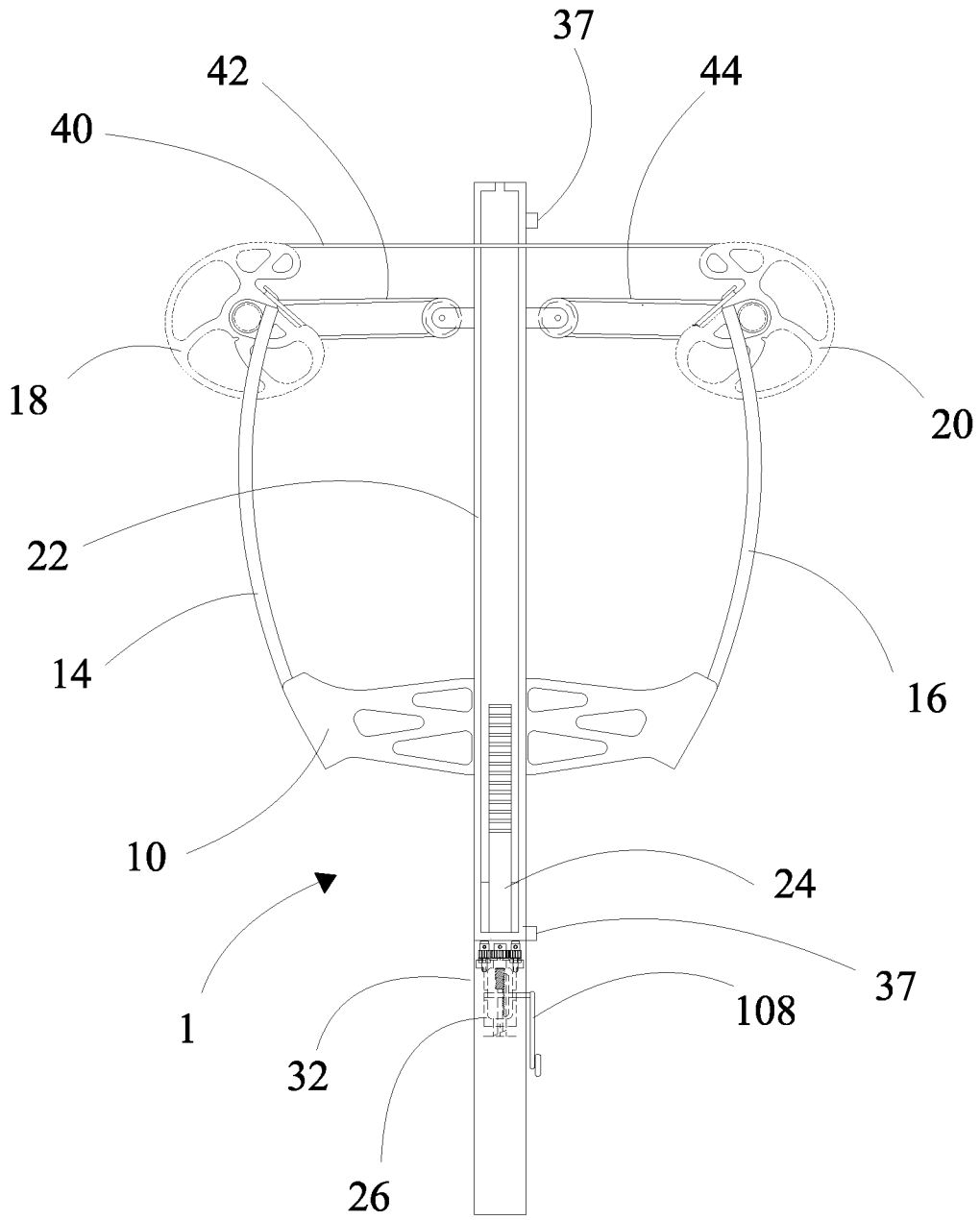
FIG. 1 is a top view of a crossbow with built in crank cocking device having a movable latch housing assembly, in the at rest position, of the present invention.
Figure 1A:
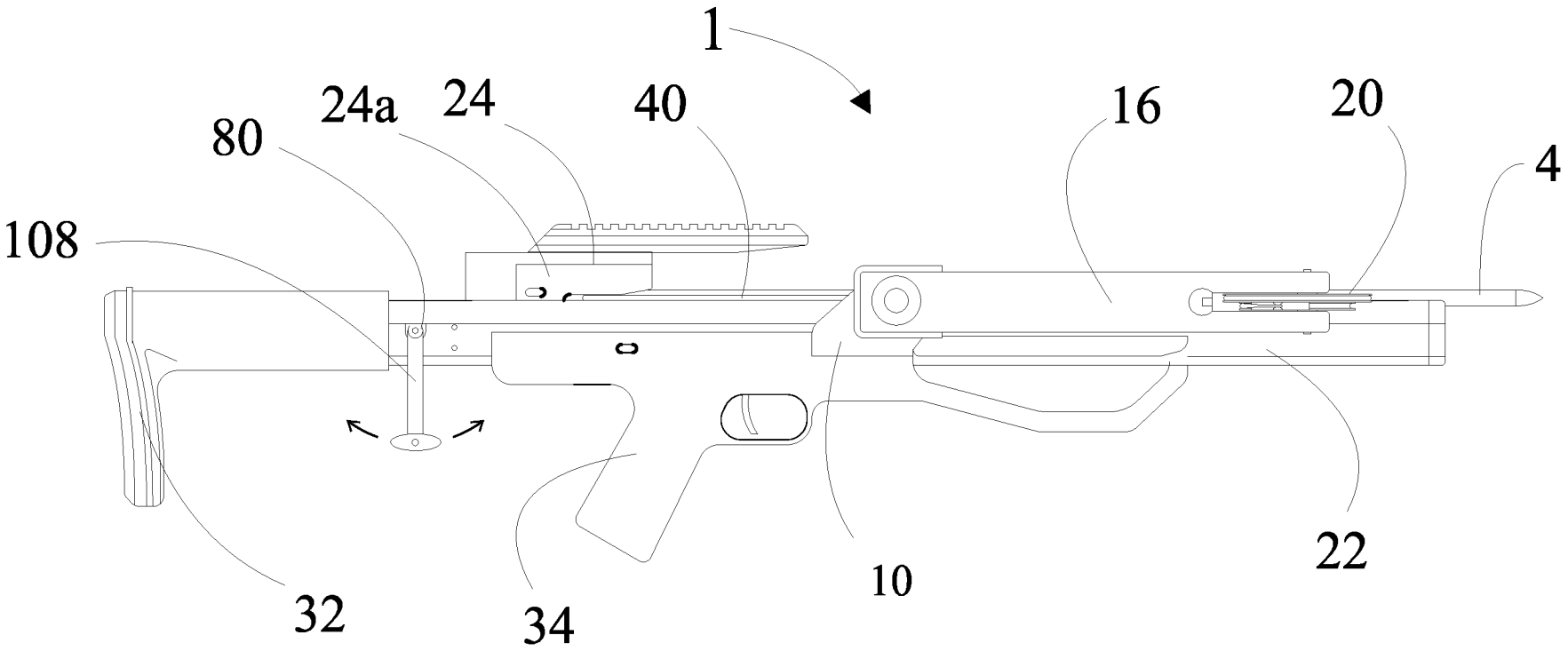
FIG. 1A is a side view of a crossbow with built in crank cocking device having a movable latch housing assembly, in the cocked position, of the present invention.
Figure 1B:
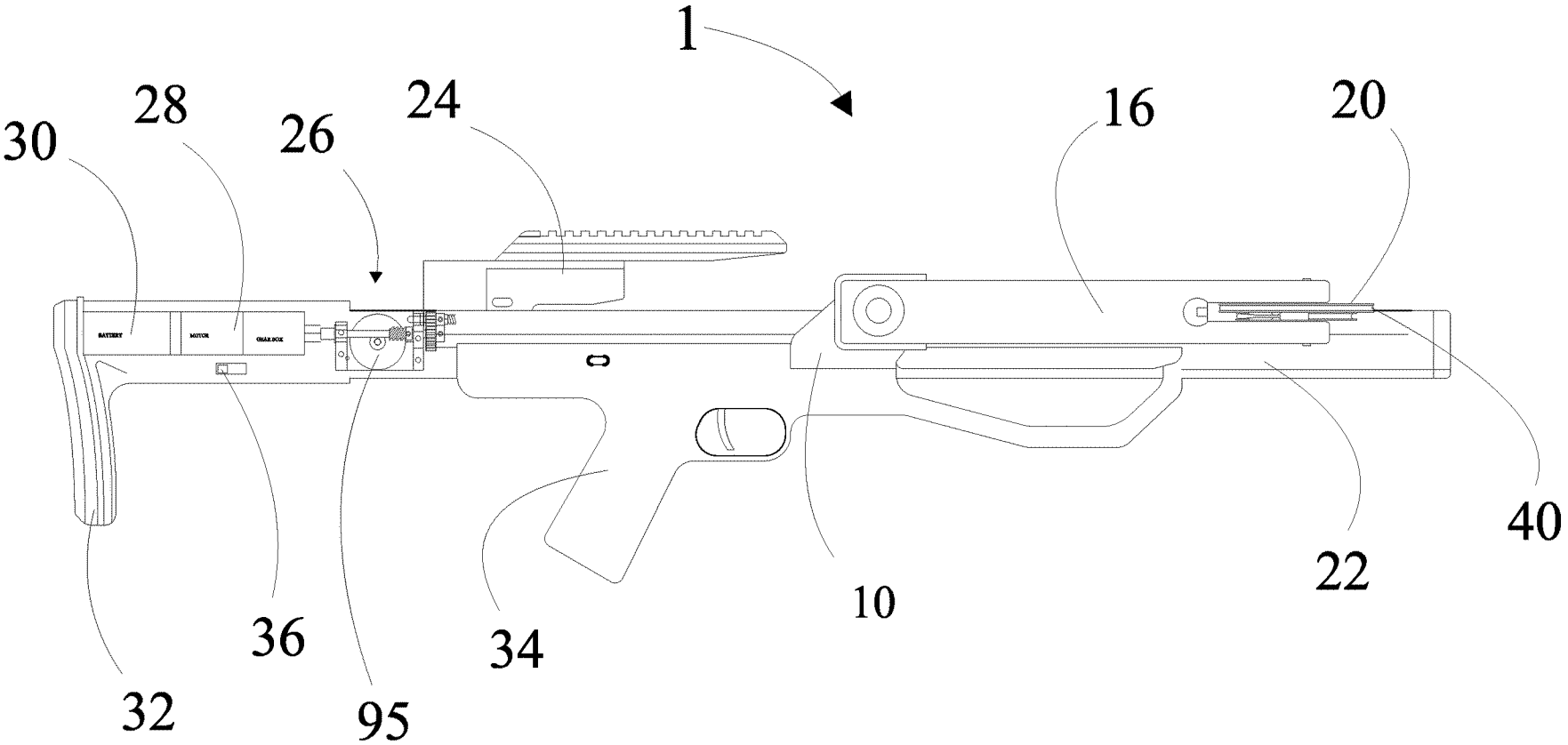
FIG. 1B is a side view of a crossbow with built in crank cocking device having a movable latch housing assembly, with the optional motor gearbox assembly and power source, in the at rest position, of the present invention.
Figure 1C:
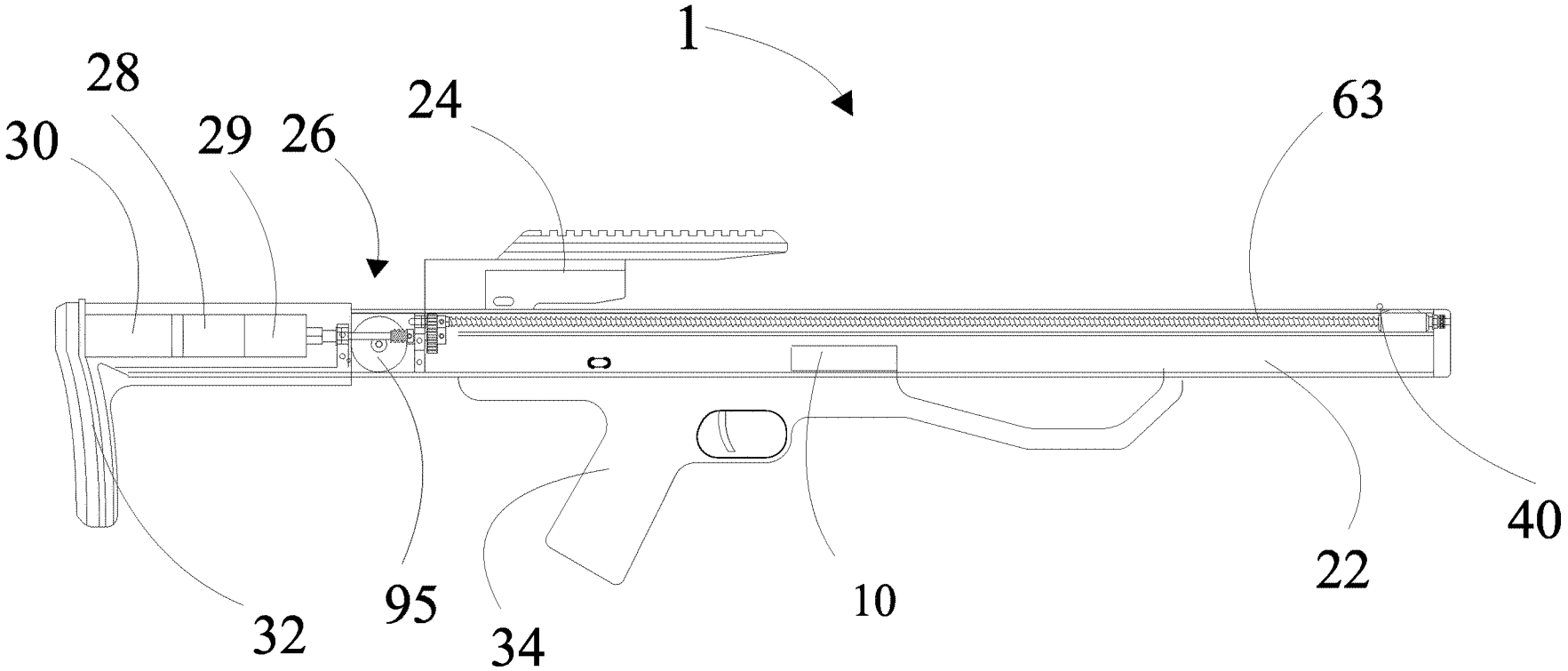
FIG. 1C is a partial cut-away side view of a crossbow with built in crank cocking device having a movable latch housing assembly, with the optional motor gearbox assembly and power source, in the at rest position. The carriage shaft assembly and crank assembly are illustrated with the crossbow of the present invention.
Figure 1D:
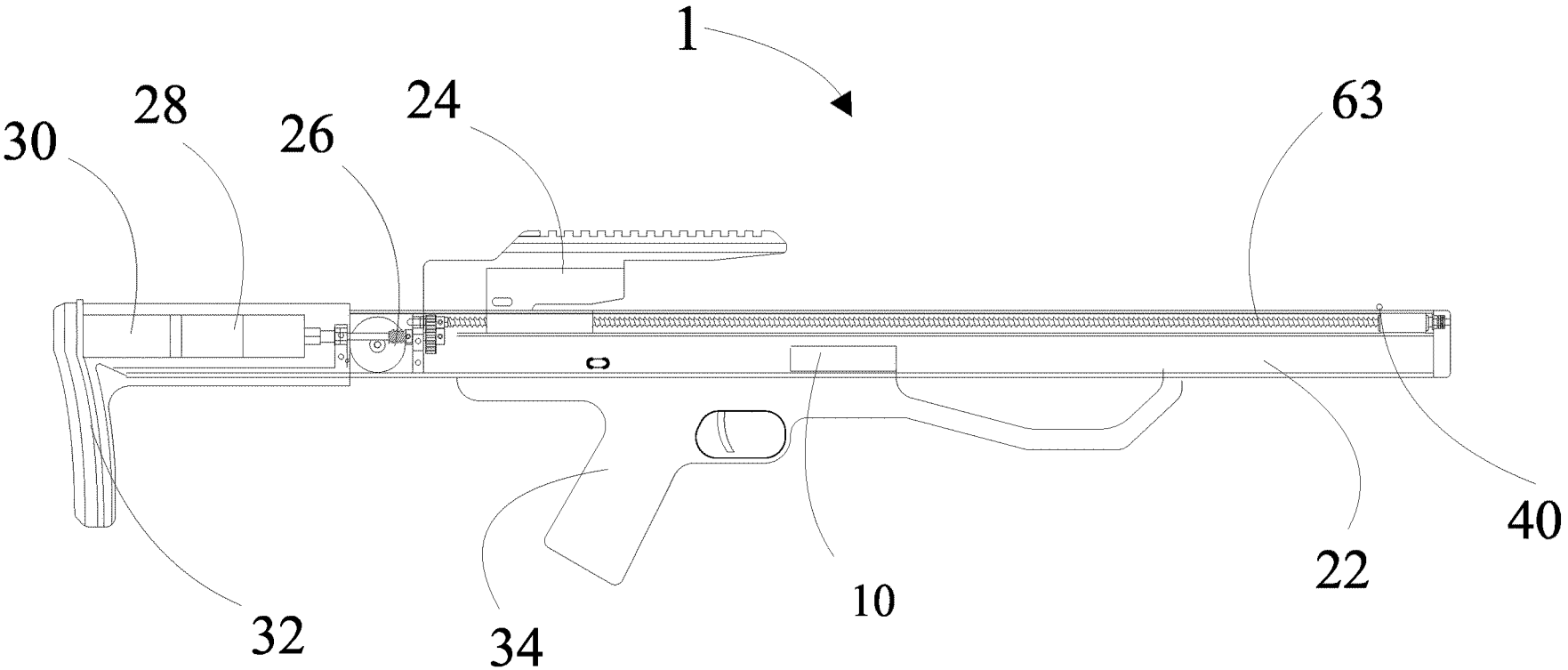
FIG. 1D is a partial cut-away side view of a crossbow with built in crank cocking device having a movable latch housing assembly, with the optional motor gearbox assembly and power source, in the at rest position. The carriage shaft assembly and crank assembly are illustrated with the crossbow of the present invention.
Figure 1E:
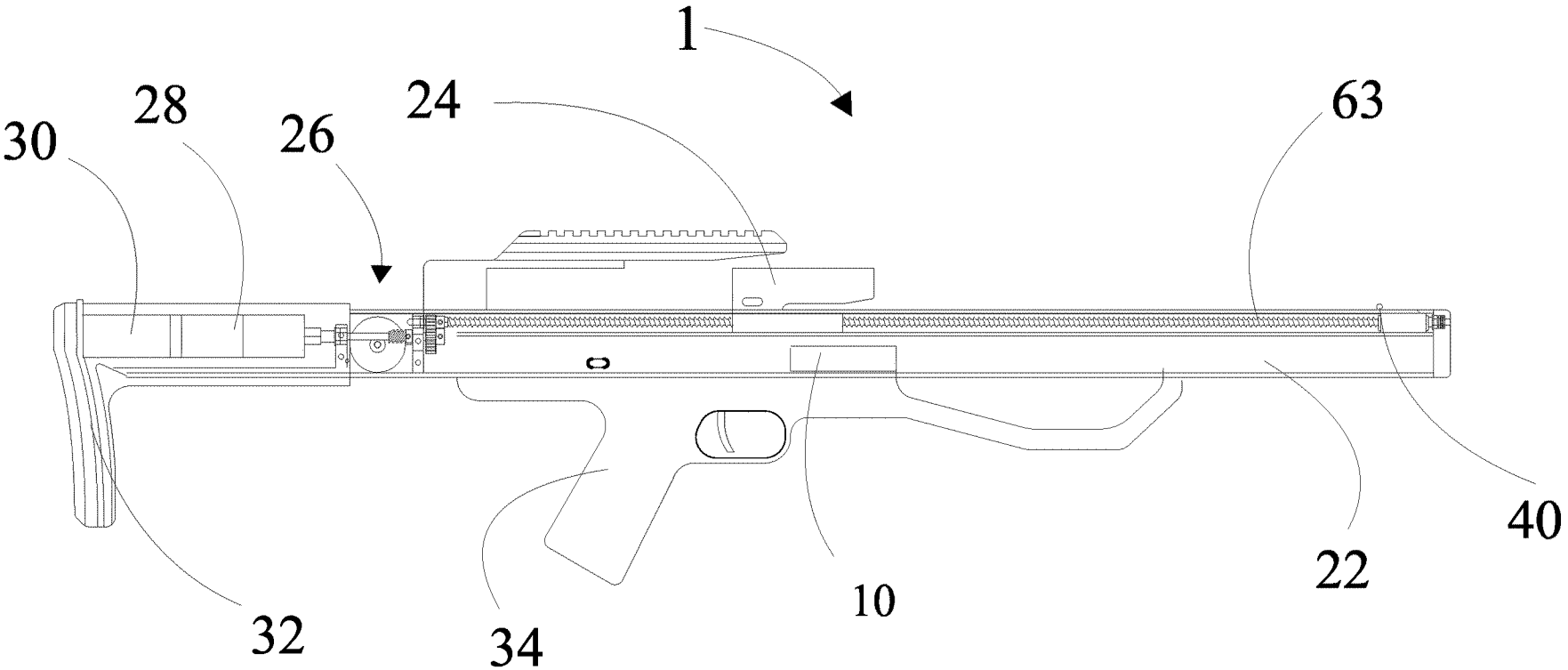
FIG. 1E is a partial cut-away side view of a crossbow with built in crank cocking device having a movable latch housing assembly, with the optional motor gearbox assembly and power source, in the partially cocked position. The carriage shaft assembly and crank assembly are illustrated with the crossbow of the present invention.
Figure 1F:
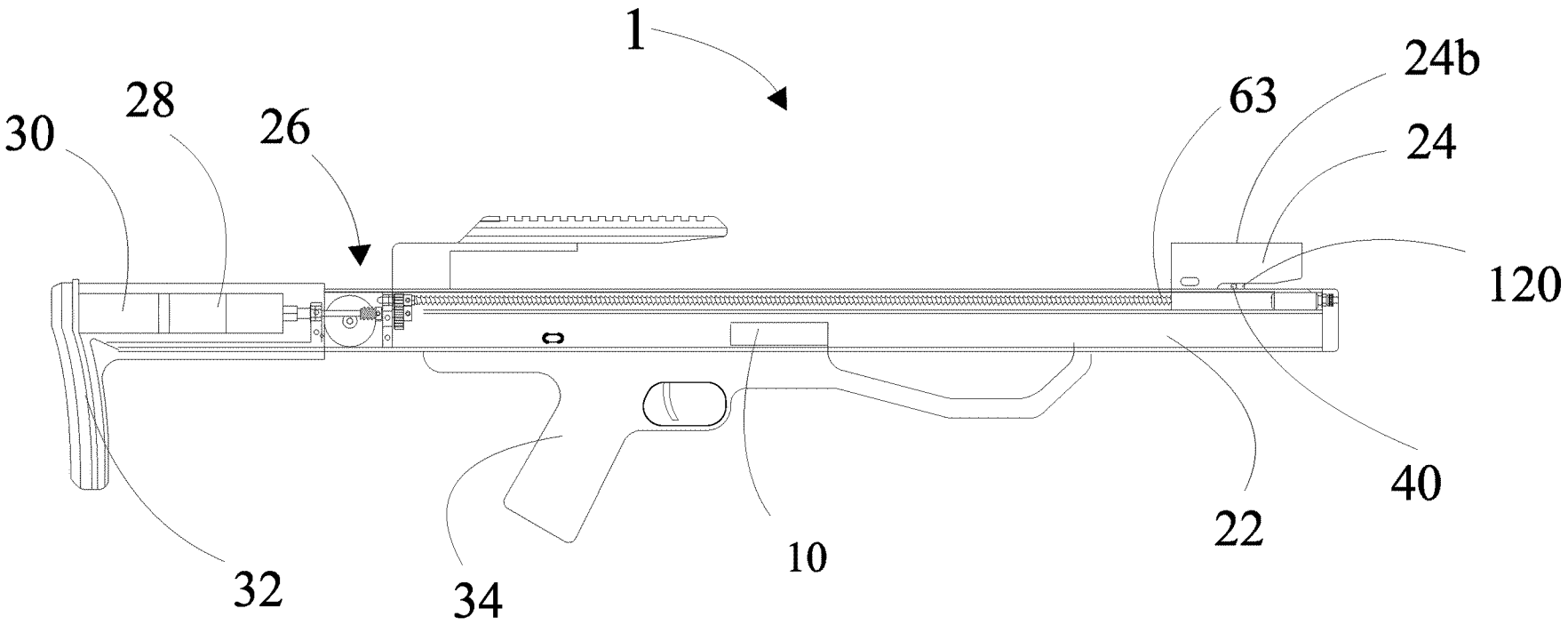
FIG. 1F is a partial cut-away side view of a crossbow with built in crank cocking device having a movable latch housing assembly, with the optional motor gearbox assembly and power source, having the latch housing assembly at the very forward position to engage the bow string. The carriage shaft assembly and crank assembly are illustrated with the crossbow of the present invention.
Figure 2:
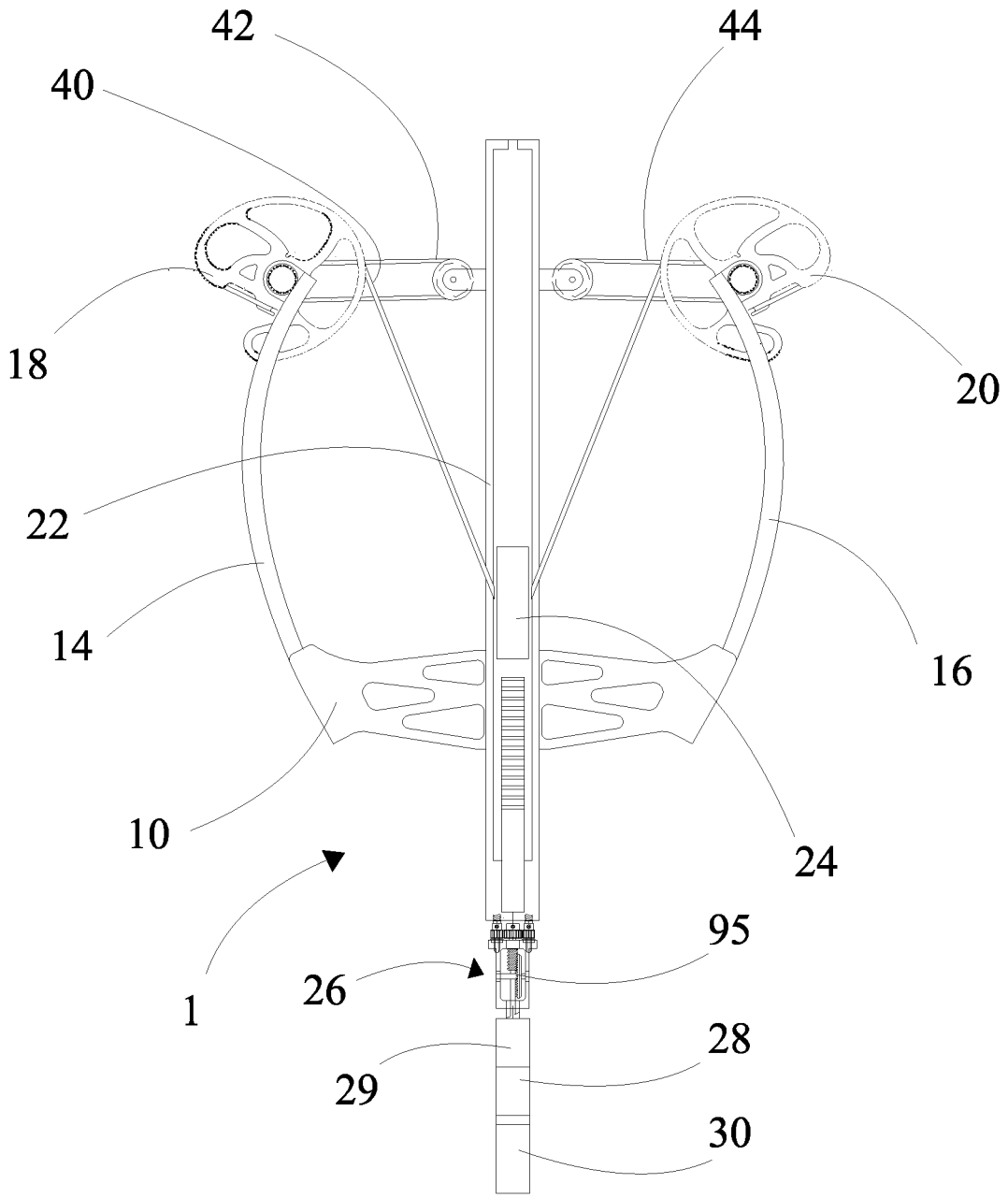
FIG. 2 is a top view of a crossbow with built in crank cocking device and optional motor gearbox assembly having a movable latch housing assembly, in the partially cocked position, of the present invention.
Figure 3:
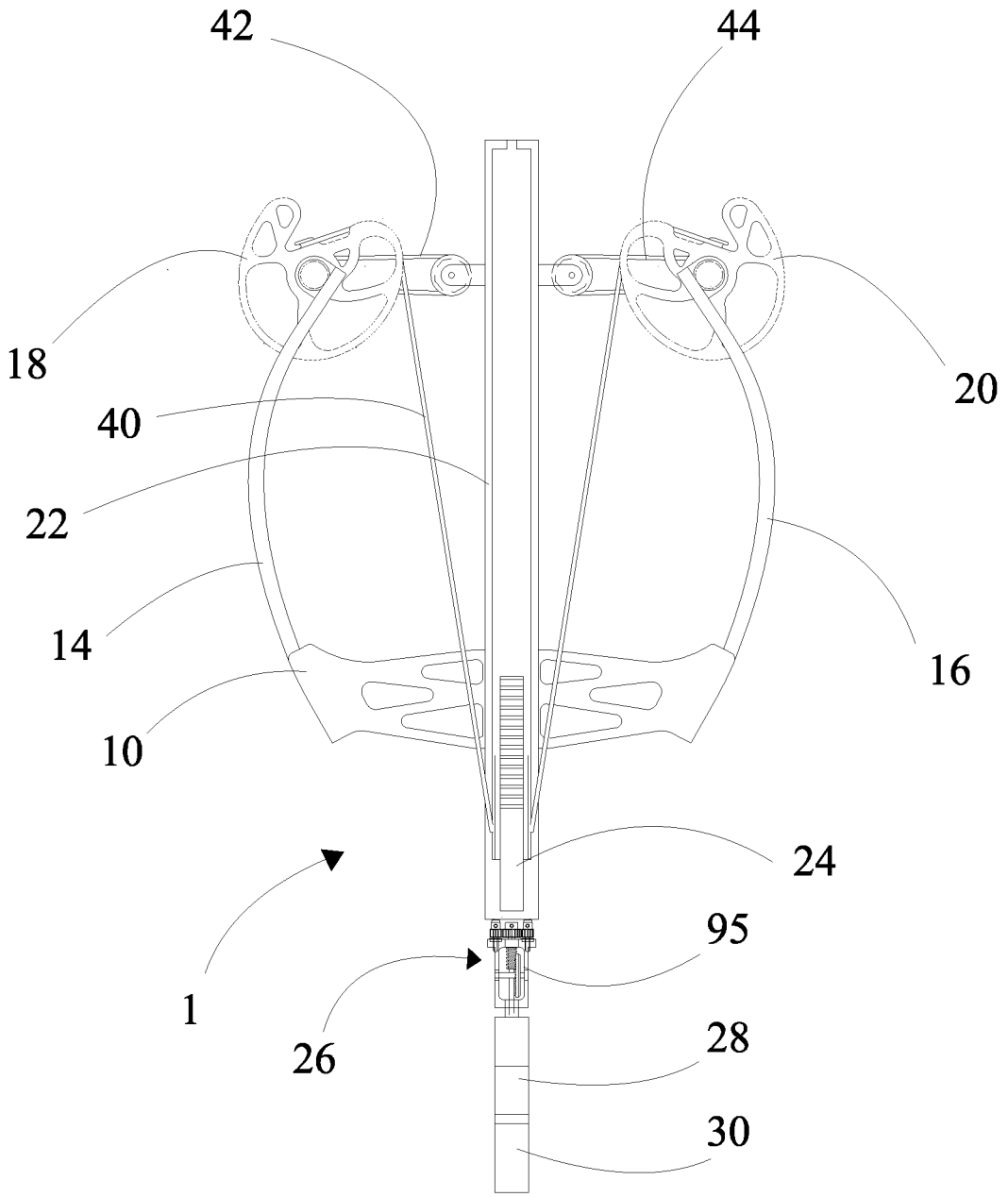
FIG. 3 is a top view of a crossbow with built in crank cocking device with built in motor gearbox assembly having a movable latch housing assembly, in the just-cocked position, of the present invention.
Figure 3A:
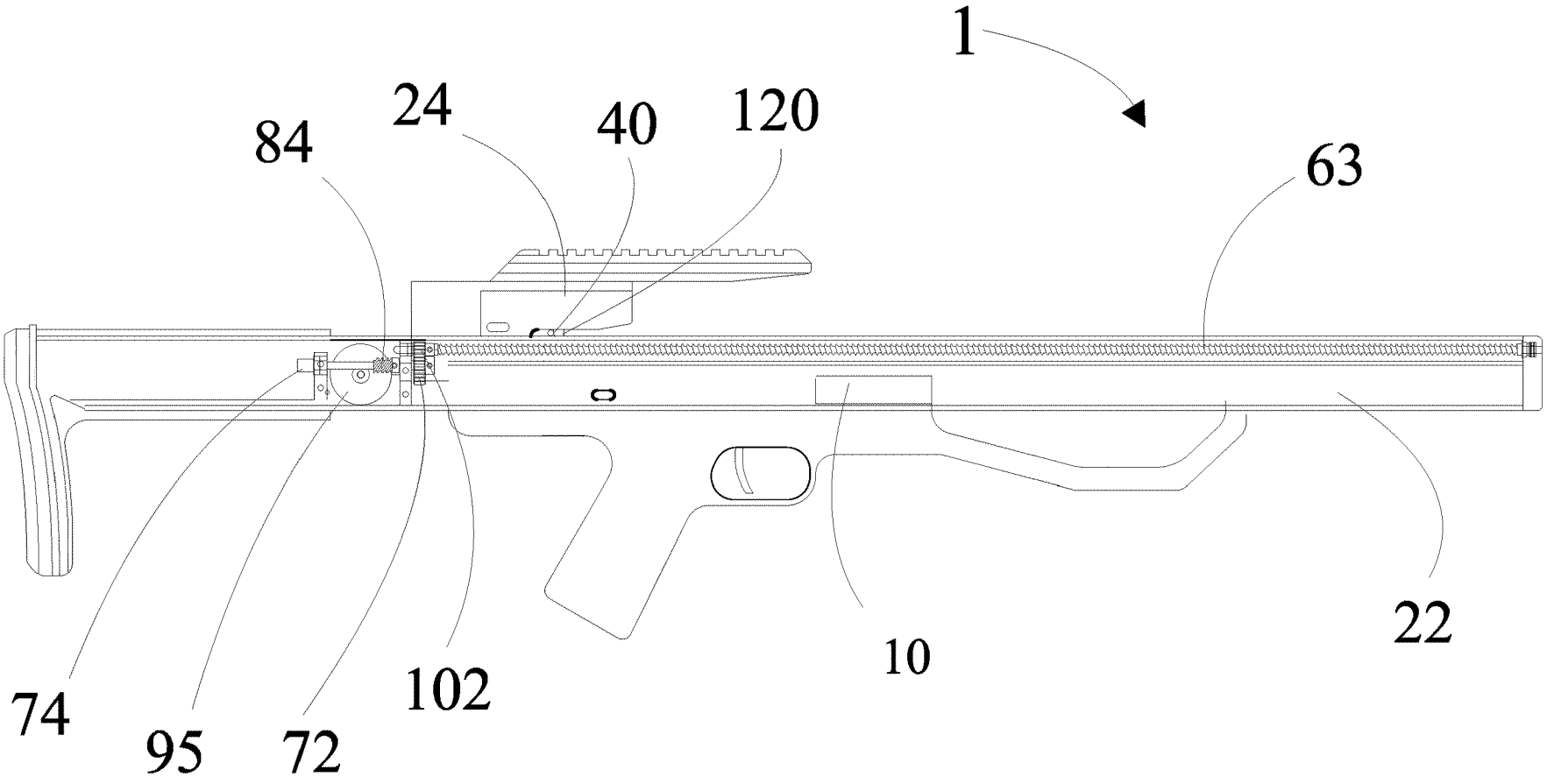
FIG. 3A is a partial cut-away side view of a crossbow with built in crank cocking device with motor gearbox assembly having a movable latch housing assembly, in the just-cocked position, of the present invention
Figure 4:
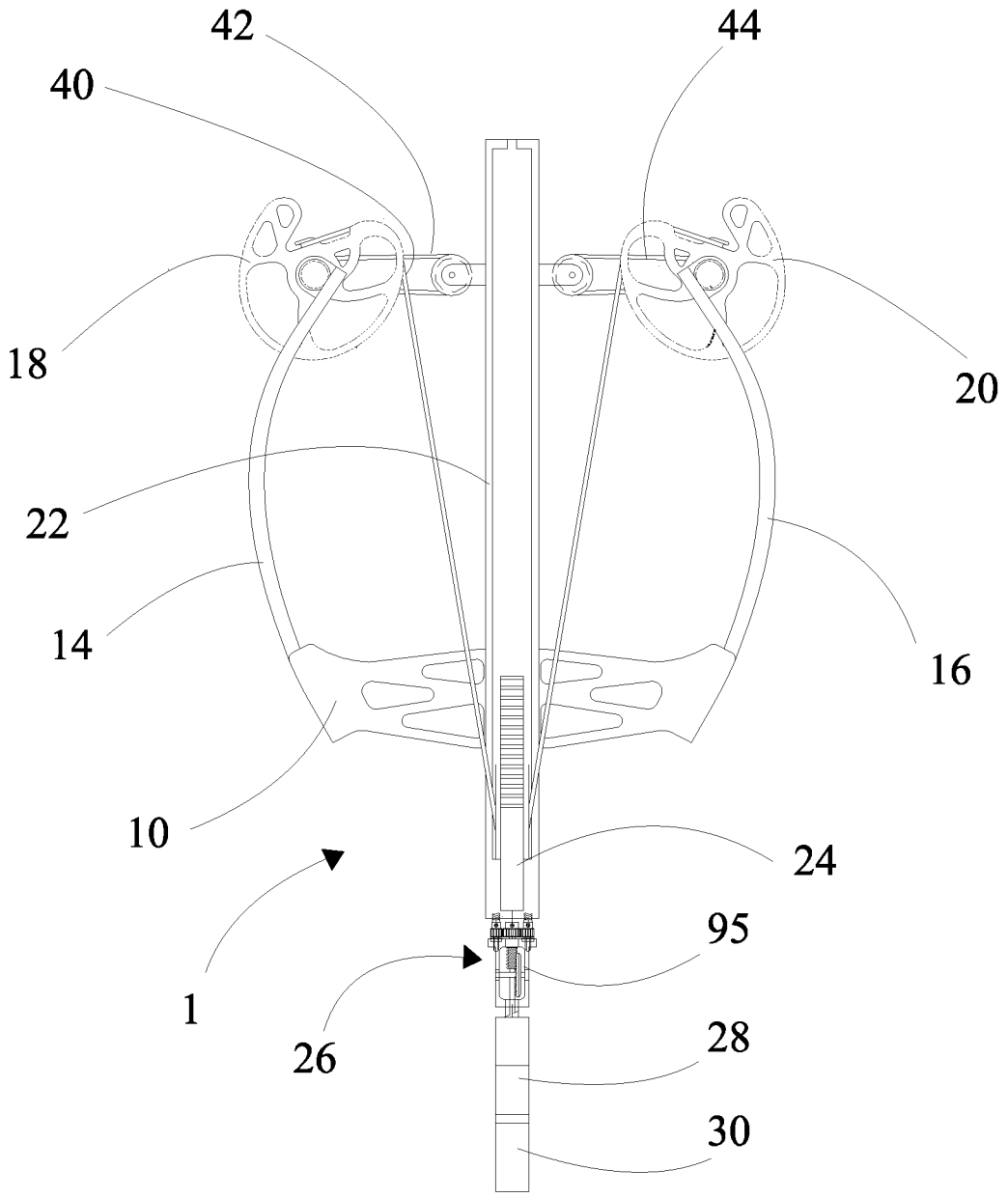
FIG. 4 is a top view of a crossbow with built in crank cocking device with motor gearbox assembly having a movable latch housing assembly, in the cocked position, of the present invention.
Figure 4A:
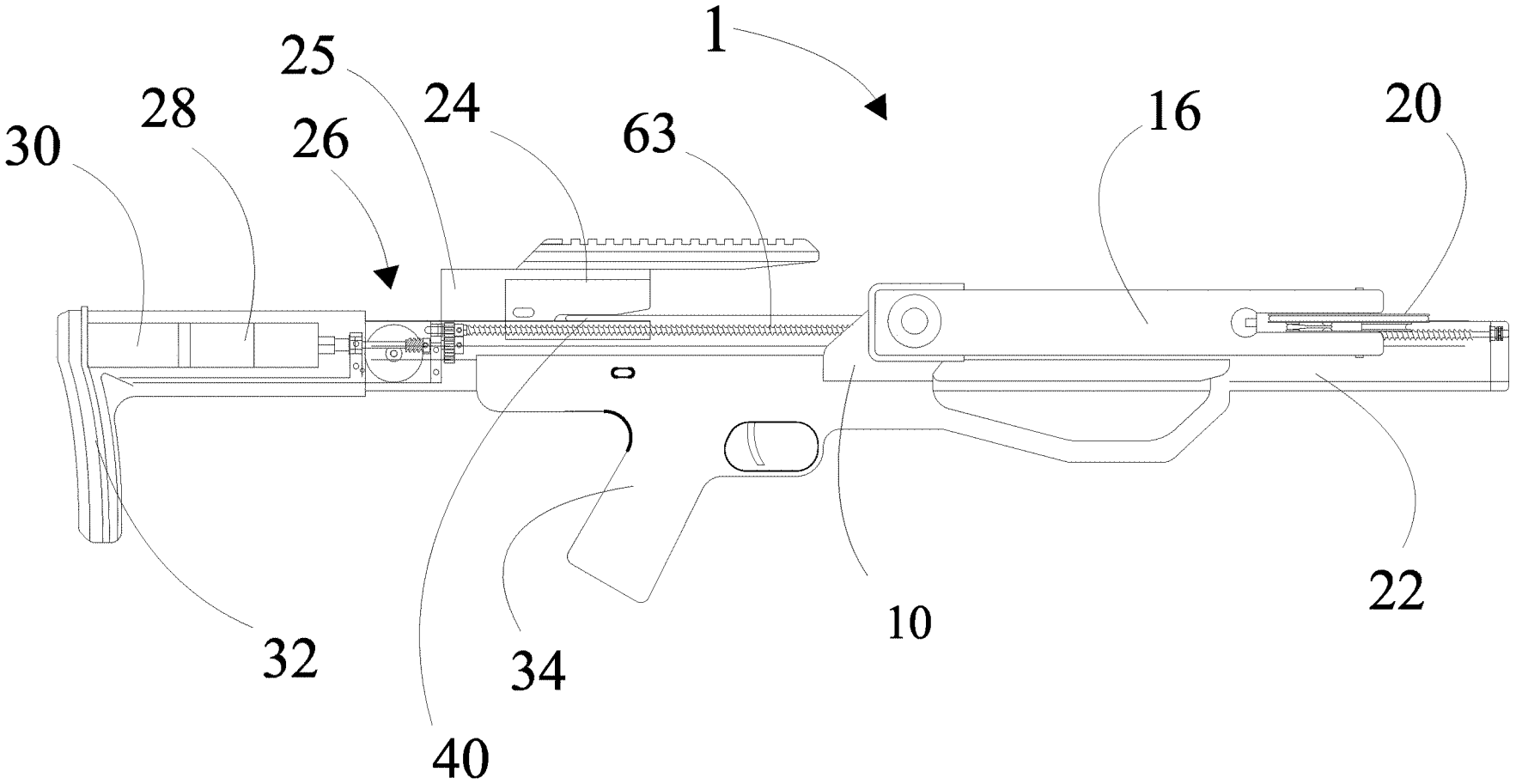
FIG. 4A is a partial cut-away side view of a crossbow with built in crank cocking device with motor gearbox assembly having a movable latch housing assembly, in the cocked position, of the present invention.
Figure 5A:
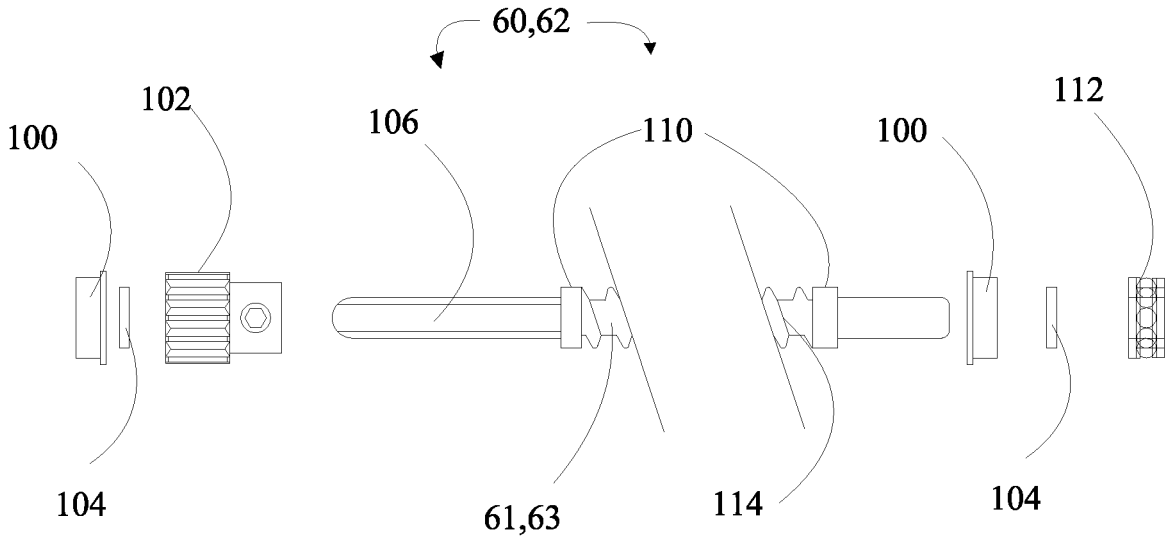
FIG. 5A is an exploded view of a carriage shaft assembly, of the present invention.
Figure 5B:
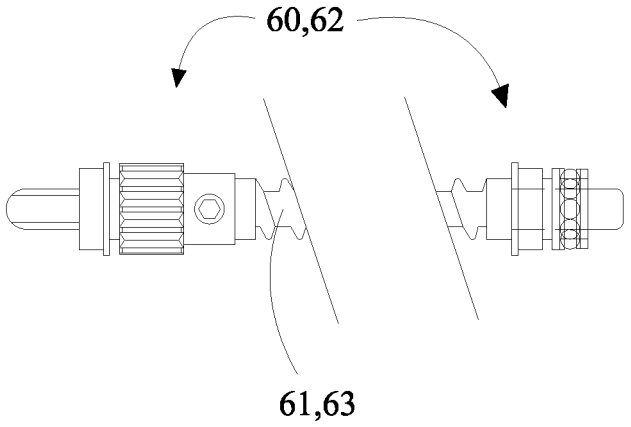
FIG. 5B is an assembled view of a carriage shaft assembly, of the present invention.
Figure 6A:
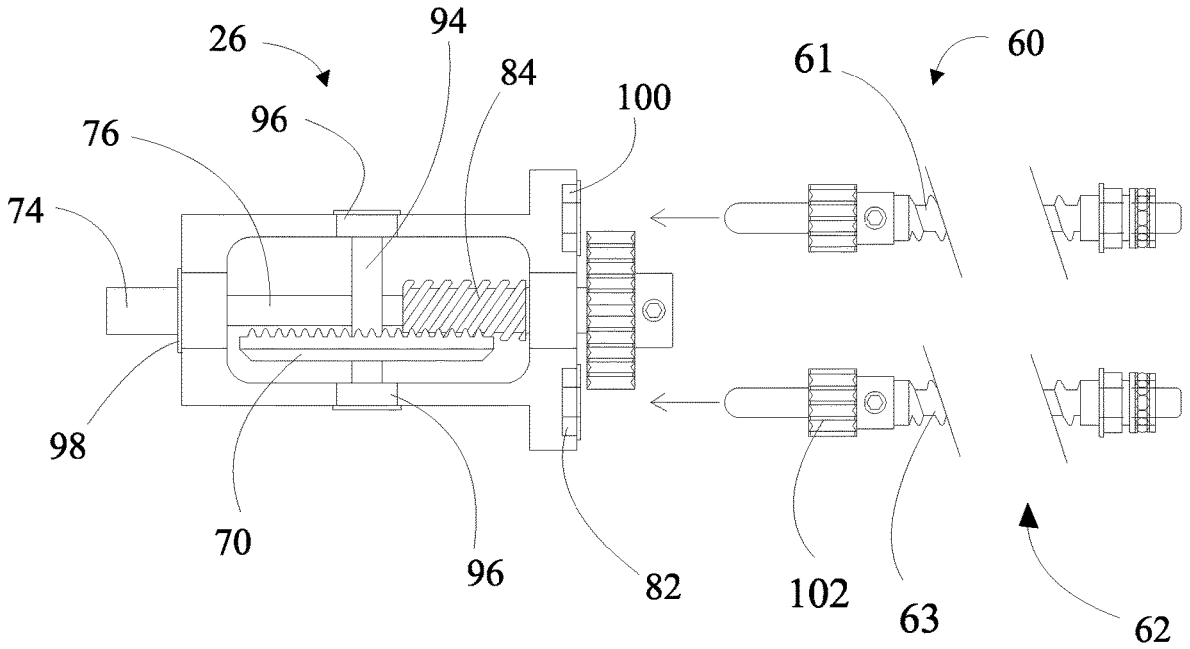
FIG. 6A is a top view of the crank assembly of the present invention.
Figure 6B:
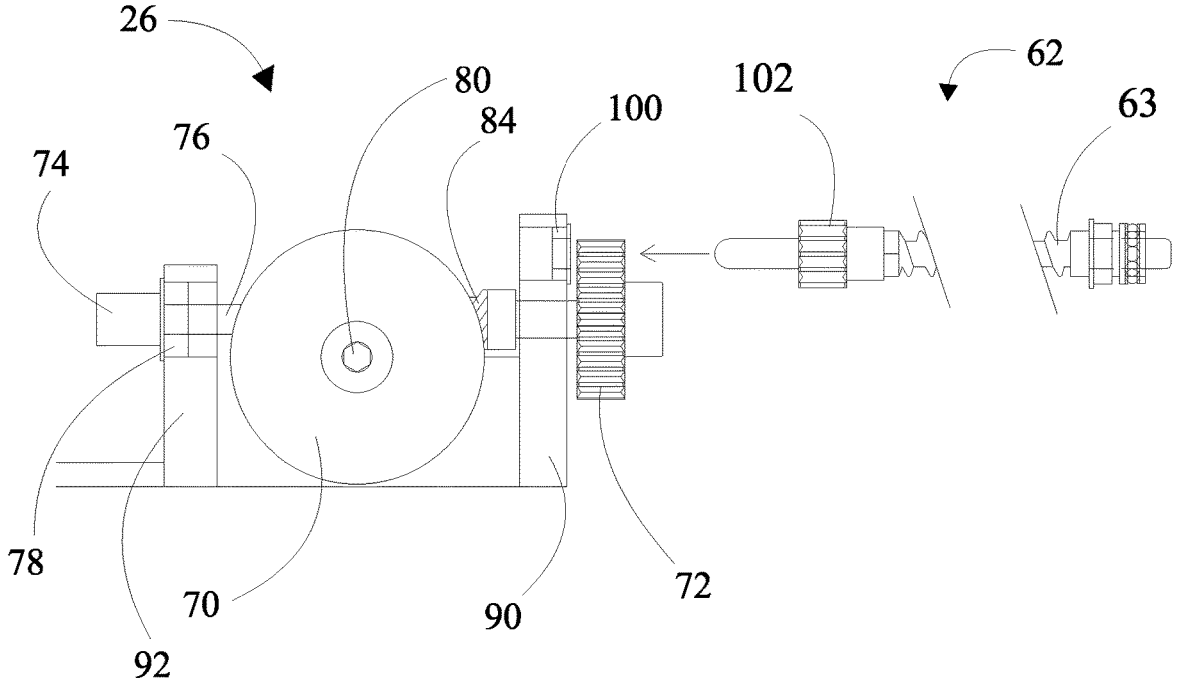
FIG. 6B is a side view of the crank assembly of the present invention.
Figure 7A:
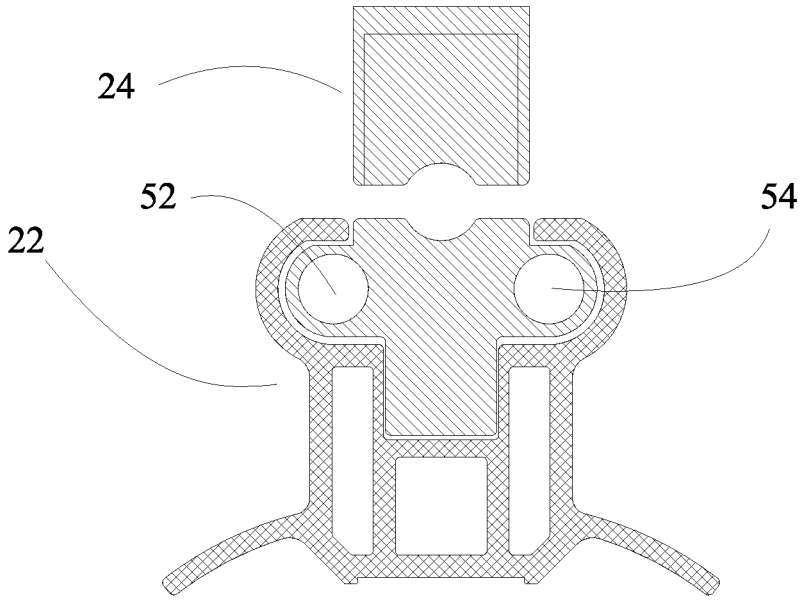
FIG. 7A is a cross section of latch housing assembly and barrel having two latch housing drive shafts of the present invention.
Figure 7B:
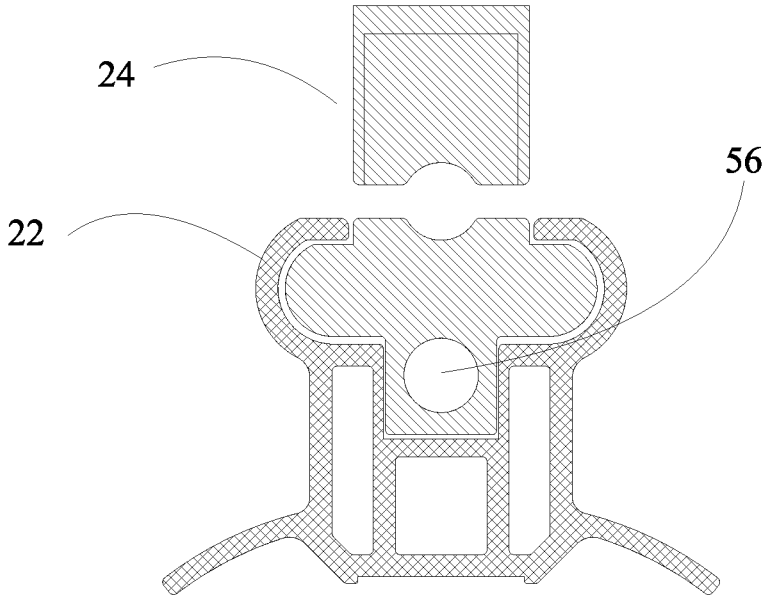
FIG. 7B is a cross section of latch housing assembly and barrel having a single latch housing drive shaft of the present invention.
Figure 8A:
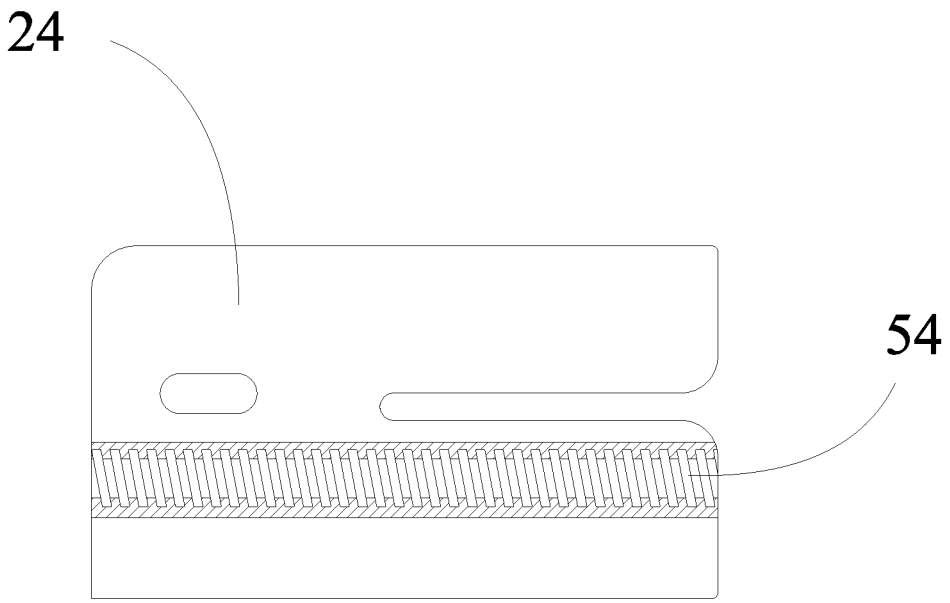
FIG. 8A is a partial cross section side view of a latch housing having a single latch housing drive shafts of the present invention.
Figure 8B:
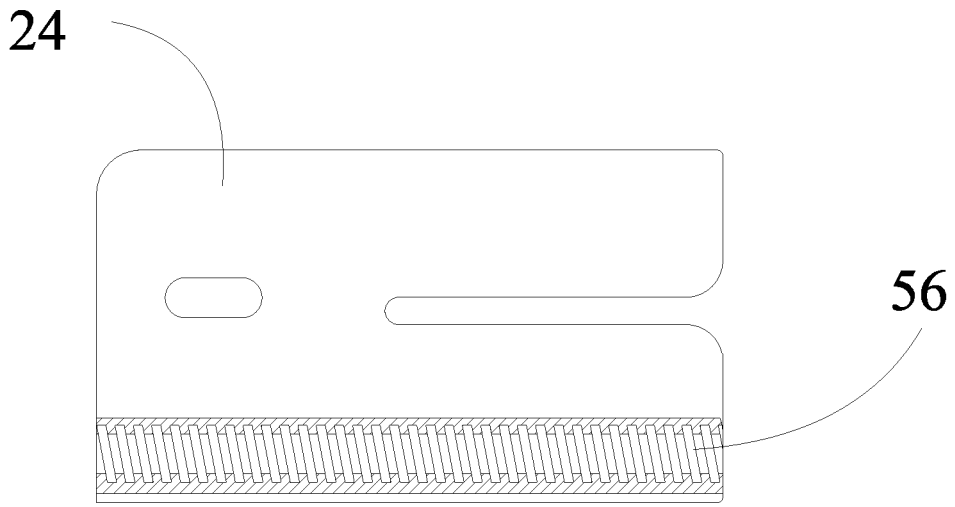
FIG. 8B is a partial cross section side view of a latch housing having two latch housing drive shafts of the present invention.
Figure 9:
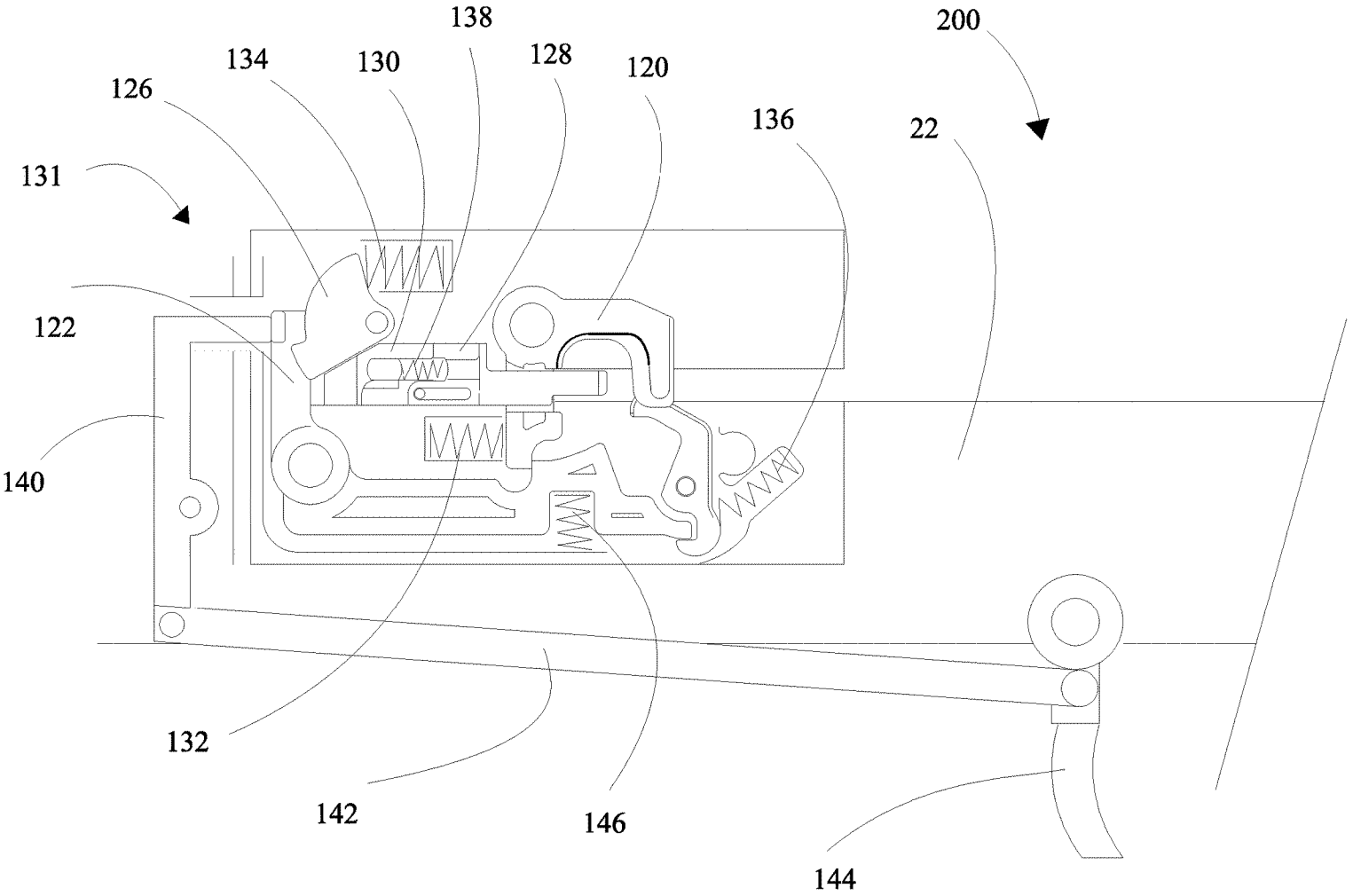
FIG. 9 is an open side view of a latch assembly of the present invention.

The enclosed invention discloses a crossbow 1, and more specifically a built in cocking mechanism for a crossbow that may also be utilized with an optional built in, removable motor gearbox assembly 28 and power source 30. The motor gearbox assembly 28 may or may not have a clutch assembly 29, whereby the rotational force applied by the said motor gearbox 28 assembly reaches a predetermined amount of force, the rotation of the main drive shaft 76 ceases. A switch 36 may be provided as to start, stop, and reverse the direction of rotation of the motor gearbox assembly 28.

In use, a clutch assembly 29 in the motor gear assembly 28 would prevent the string latch housing assembly 24 from traveling past the predetermined forward or rearward position of the string latch housing assembly 24 during the cocking and unlocking procedure. A micro-switch with electronic eye 37 may also be used to control the operation of the motor gear box assembly 28.

Unique to the disclosed invention, is the use of a hand crank assembly 26. A hand crank 108 is coupled to a crank drive gear 95 mating to a drive shaft pinion gear 84. The drive shaft 76 is in-turn connected to a main drive shaft drive gear 72 on a first end, and a motor gearbox assembly coupling 74 at a second end. The main drive shaft drive gear 72 is coupled to the latch housing shaft drive gears 102. As the hand crank 108 is turned, rotational forces of the hand crank drive gear 95 turn the drive shaft pinion gear 84, in turn causing rotation of the drive shaft drive gear 72. As the drive shaft drive gear 72 rotates, it causes rotation of the first and second string latch housing drive shafts 61 and 63. At least one internally threaded engagement journal 54 is coupled with the string latch housing assembly 24 on the string latch housing drive shaft 61. The first and second string latch housing drive shaft assemblies 60 and 62 act as a worm drive or acme thread conveyor. As the first and second string latch housing drive shafts 61 and 63 rotate, the string latch housing 24 moves forward or backwards, depending on the direction of rotation of the first and second string latch housing drive shafts 61 and 63 rotate.

When in use, the hand crank 108 is turned a first direction, causing the string latch housing assembly 24 to move forward and engage the string 40. Once the string catch 120 is latched to the string 40, the hand crank 108 is rotated in a second direction until the string latch housing assembly 24 is in the ready-to-fire position.

Another unique feature of the disclosed invention is the optional built-in, removable motor gearbox assembly 28 that may take the place of the hand crank 108, without removal of the hand crank assembly 26.

Unique to the disclosed invention, is the use of a string latch housing assembly 24 movable by an integrated screw-drive type system. The use of an ACME thread is preferred, however any such system utilizing a rotational force through a screw-type shaft which moves a string latch housing assembly 24 from a first position 24*a* to a second position 24*b*, and again to a first position 24*a*. Said screw-type system has at least a first string latch housing shaft assembly 60. Said assembly 60 having a string latch housing drive shaft 61, threads 114, string latch housing drive shaft drive gear 102, journaled with bearings 100 at a first and second end, and received by at least a first internally threaded engagement journal 54 of the said string latch housing assembly 24. Said at least a first string latch housing drive shaft 61 is coupled to a rotational power source by the string latch housing drive shaft drive gear 102, which causes said string latch housing drive shaft 61 to rotate a first direction or a second direction. As said string latch housing drive shaft 61 rotates a first direction or a second direction, the threads 114 of said string latch housing drive shaft 61 cause he said string latch housing assembly 24 to move a first direction or a second direction. Disclosed in this invention is a device wherein said string latch housing assembly 24 is in a first position; a first directional rotational force is applied to string latch housing drive shaft 61; string latch housing drive shaft 61 moves string latch housing assembly 24 from a string latch housing assembly first position 24*a* to a string latch housing assembly second position 24*b*, wherein the string latch 120 engages the string 40; a second direction rotational force is applied to the string latch housing drive shaft 61; string latch housing drive shaft 61 moves said string latch housing assembly 24 and string 40 to said string latch housing assembly first position 24*a*.

The use of one or more integrated string latch housing drive shafts 61 and 63 may be used to accomplish movement of said string latch housing assembly 24. The use of an integrated string latch housing drive shaft type system of the disclosed invention is not limited to movement of a string latch housing assembly 24, but may be used to move as few as one component from a first position to a second position to assist in the process of moving said string 40 from a first position to a second position.

Further disclosed is a unique string latch assembly 200 and automatic safety device. Said string latch assembly 200 comprises a string latch 120, a seer lever 122, an anti-dry fire/sear-lock lever 124, springs, and an automatic safety assembly 131. Said automatic safety assembly 131 consists of three components and two springs. A first compression spring 138 is positioned between the front safety portion 128 and the rear safety portion 130, comprising a safety assembly. A second compression spring 134 is engaged with the safety pivot block 126. The automatic safety assembly 131 has a first extended position, a compressed position, and a second extended position.

Though the preferred embodiment of the present invention is disclosed, it in no way limits the scope of the Patent to the preferred disclosure. Alterations of design and alternatives to power sources may be incorporated to provide rotational forces and forwards and rear movement of a string engagement and retention means.

We claim:

1. A crossbow having an integral crank cocking device, comprising:

a hand crank main gear engages a pinion gear retained on a main drive shaft, a main drive shaft drive gear is retained on an end of said main drive shaft, said main drive shaft gear engages a pair of carriage shaft drive gears, said pair of carriage shaft drive gears are fixed to a pair of carriage shafts, an end of said pair of carriage shafts are rotatably retained in a crank housing, a crank handle is turned in a first or second direction, the hand crank main gear is rotated in a first direction or a second direction, said first direction for moving a string latch housing from a first position to a second position at a front of the crossbow, said crank handle is rotated in said second direction which moves said string latch housing and the string to a ready-to-fire or said first position.

2. The crossbow having an integral crank cocking device of claim 1, further comprising:

a drive shaft coupling on a first end of said main drive shaft.

3. A crossbow having an integral crank cocking device, comprising:

a hand crank main gear engages a pinion gear retained on a main drive shaft, a main drive shaft drive gear is retained on an end of said main drive shaft, said main drive shaft gear engages a pair of carriage shaft drive gears, said pair of carriage shaft drive gears are fixed to a pair of carriage shafts, an end of said pair of carriage shafts are rotatably retained in a crank housing, a crank handle is turned in a first or second direction, the hand crank main gear is rotated in a first direction or a second direction, said first direction for moving a string latch housing from a first position to a second position at a front of the crossbow, said crank handle is rotated in said second direction which moves said string latch housing and the string to a ready-to-fire or said first position, a motor gearbox is coupled to said main drive shaft on a second end of said main drive shaft, said motor gearbox assembly having a forward, stop, and reverse direction, said pair of carriage shafts are rotated by either said crank handle or said motor gearbox.

4. The crossbow having an integral crank cocking device of claim 3 wherein: said power source is external.

5. The crossbow having an integral crank cocking device of claim 3, further comprising:

a plurality of micros switches to control end travel of said latch housing.

6. The crossbow having an integral crank cocking device of claim 3, further comprising:

a plurality of electronic eyes to control end travel of said latch housing.

7. The crossbow having an integral crank cocking device of claim 3, further comprising:

a clutch assembly coupled to said motor gearbox assembly.

8. The crossbow having an integral crank cocking device of claim 3 wherein:

said motor gearbox is de-couple-able from said main drive shaft.

9. The crossbow having an integral crank cocking device of claim 3 wherein:

said motor gearbox assembly is removable.

10. A crossbow having an integral electric gearbox motor cocking device, comprising:

an output shaft of said motor gearbox is coupled with a main drive gear, said main drive gear engages at least one carriage shaft drive gear, said at least one carriage shaft drive gear is fixed to at least one carriage shaft, an end of said at least one carriage shaft is rotatably retained in a crank housing; and a switch is selectable to a first position or a second position, said motor gearbox powers said main drive gear in a first direction or a second direction, said first direction for moving a string latch housing to a front of the crossbow, said second direction moves said string latch housing and a string to a ready-to-fire position.

11. The crossbow having an integral electric gearbox motor cocking device of claim 10, further comprising:

a second string latch housing drive gear and a second latch housing drive shaft.

12. The crossbow having an integral electric gearbox motor cocking device of claim 10, further comprising:

said motor gearbox is engage-able to a clutch.

13. A crossbow comprising:

at least one threaded shaft, which is located below a top of a frame of the crossbow, said at least one threaded shaft has the capability of rotating in a first direction and a second direction, and a string engagement device, said string engagement device having a string portion which engages a bowstring, and a thread portion which threadably engages said threaded shaft, said string portion is capable of engaging, retaining and releasing the bowstring, wherein said string engagement device is in a first position when said first threaded shaft is rotated in a first direction, said string engagement device moves from said first position in a first direction to a second position, wherein said string engagement device engages the bowstring, said at least one threaded shaft is rotated in a second direction, said string engagement device moves from the second position in a second direction to the first position, a device for releasing the bowstring from said string retaining device.

14. The crossbow of claim 13, further comprising:

a device for manually rotating said integrated threaded shaft.

* * * * *